US008061083B2

(12) United States Patent
Shirai et al.

(10) Patent No.: US 8,061,083 B2
(45) Date of Patent: Nov. 22, 2011

(54) DOOR NOISE SUPPRESSING STRUCTURE IN OPEN/CLOSE BODY DRIVE APPARATUS

(75) Inventors: Nakatsune Shirai, Iwata (JP); Hidenori Ishihara, Hamamatsu (JP); Tomoki Yamashita, Hamamatsu (JP); Hiroaki Yamamoto, Toyohashi (JP); Katsumi Endo, Kosai (JP)

(73) Assignee: Asmo Co., Ltd. (JP)

( * ) Notice: Subject to any disclaimer, the term of this patent is extended or adjusted under 35 U.S.C. 154(b) by 397 days.

(21) Appl. No.: 12/360,469

(22) Filed: Jan. 27, 2009

(65) Prior Publication Data

US 2009/0188168 A1 Jul. 30, 2009

(30) Foreign Application Priority Data

Jan. 28, 2008 (JP) ..... 2008-016498

(51) Int. Cl.
*E05F 11/38* (2006.01)

(52) U.S. Cl. ..... 49/349; 49/351

(58) Field of Classification Search ..... 49/348, 49/349, 350, 351

See application file for complete search history.

(56) References Cited

U.S. PATENT DOCUMENTS 2,972,688 A * 2/1961 Mahlfeldt ..... 310/81
4,545,021 A * 10/1985 Suzuki et al. ..... 700/279
4,986,029 A * 1/1991 Richter ..... 49/349
5,282,309 A * 2/1994 La Rue ..... 29/736
5,513,468 A * 5/1996 Diestelmeier ..... 49/375
5,595,025 A * 1/1997 MacPhail-Fausey ..... 49/351
6,075,298 A * 6/2000 Maue et al. ..... 310/12.14
6,320,335 B1 * 11/2001 Saitou ..... 318/9
6,323,757 B1 * 11/2001 Nagai ..... 340/407.1

FOREIGN PATENT DOCUMENTS

JP 2001-90796 A 4/2001

* cited by examiner

*Primary Examiner* — Katherine Mitchell

*Assistant Examiner* — Justin Rephann

(74) *Attorney, Agent, or Firm* — Caesar, Rivise, Bernstein, Cohen & Pokotilow, Ltd.

(57) ABSTRACT

A drive apparatus for opening and closing a window glass provided in a door having an inner panel is disclosed. The drive apparatus includes a motor provided in the door and a regulator that receives drive force from the motor and selectively open and close the window glass. The door noise includes motor operating noise and vibration transmission noise that is generated when vibration of the motor is transmitted to the inner panel via the regulator. The motor is configured such that a first-order frequency component in vibration of the motor is greater than any other nth component (n is an integer greater than or equal to two), so that the first-order frequency component in the door noise is greater than any other nth frequency component (n is an integer greater than or equal to two).

2 Claims, 4 Drawing Sheets

DOOR NOISE SUPPRESSING STRUCTURE IN OPEN/CLOSE BODY DRIVE APPARATUS

BACKGROUND OF THE INVENTION

The present invention relates to a door noise suppressing structure in an open/close body drive apparatus.

Conventionally, for example, Japanese Laid-Open Patent Publication No. 2001-90796 discloses an open/close body drive apparatus. This apparatus uses drive power of a motor to perform opening and closing operation of an open/close body through a regulator fixed to the inner panel in a door.

Noise of the door in which the apparatus according to the above document is used includes noise generated when the motor is activated (motor noise) and noise due to vibration of the inner panel caused by the motor (vibration transmission noise).

In general, the vibration and operating noise of a motor have an order frequency component that is maximized in a high frequency range due to the number of slots and the number of poles of magnets. For example, suppose that the speed of the output shaft of a motor having two poles and eight slots (speed of the rotor after being reduced) is 80 [rpm] (at 12 V, load of 1 N·m), and the speed reduction rate is 79. In this case, the first-order frequency component f1 of the motor is expressed by the following expression.

$$f1=80\times79/60=105.3\ [\mathrm{Hz}] \quad (1)$$

The order frequency component fp of the motor at which the order frequency component of the maximum vibration and operating noise exists is a frequency obtained by multiplying the frequency component f1 by the greatest common divisor of the number of poles (2) and the number of slots (8), or 8.

$$fp=105.3\times8=842.4\ [\mathrm{Hz}] \quad (2)$$

Since the order frequency component of the maximum vibration and operating noise exists in such a high frequency range, the noise of the door is a high-pitched unpleasant noise.

SUMMARY OF THE INVENTION

Accordingly, it is an objective of the present invention to provide an open/close body drive apparatus that makes high-pitched unpleasant door noise harder to perceive.

To achieve the foregoing objective and in accordance with a first aspect of the present invention, a drive apparatus for opening and closing an open/close body provided in a door having an inner panel is provided. The drive apparatus includes a motor provided inside the door and a regulator that is located in the door and fixed to the inner panel. The regulator receives drive force from the motor and selectively open and close the open/close body. Door noise is generated when the motor is operating, and the door noise includes motor operating noise and vibration transmission noise that is generated when vibration of the motor is transmitted to the inner panel via the regulator. The motor is configured such that a first-order frequency component in vibration of the motor is greater than any other nth component (n is an integer greater than or equal to two), so that the first-order frequency component in the door noise is greater than any other nth frequency component (n is an integer greater than or equal to two).

In accordance with a second aspect of the present invention, a method for suppressing noise in a door having a inner panel is provided. The door incorporates a drive apparatus that opens and closes an open/close body provided in the door. The drive apparatus includes a motor and a regulator fixed to the inner panel. The regulator receives drive force from the motor and selectively opens and closes the open/close body. Noise is generated in the door when the motor is operating, the door noise including motor operating noise and vibration transmission noise that is generated when vibration of the motor is transmitted to the inner panel via the regulator. The method includes: making a first-order frequency component in vibration of the motor greater than any other nth component (n is an integer greater than or equal to two), so that the first-order frequency component in the door noise is greater than any other nth frequency component (n is an integer greater than or equal to two).

DETAILED DESCRIPTION OF THE PREFERRED EMBODIMENT

A vehicle power window apparatus according to one embodiment of the present invention will now be described with reference to the drawings.

Figure 1:
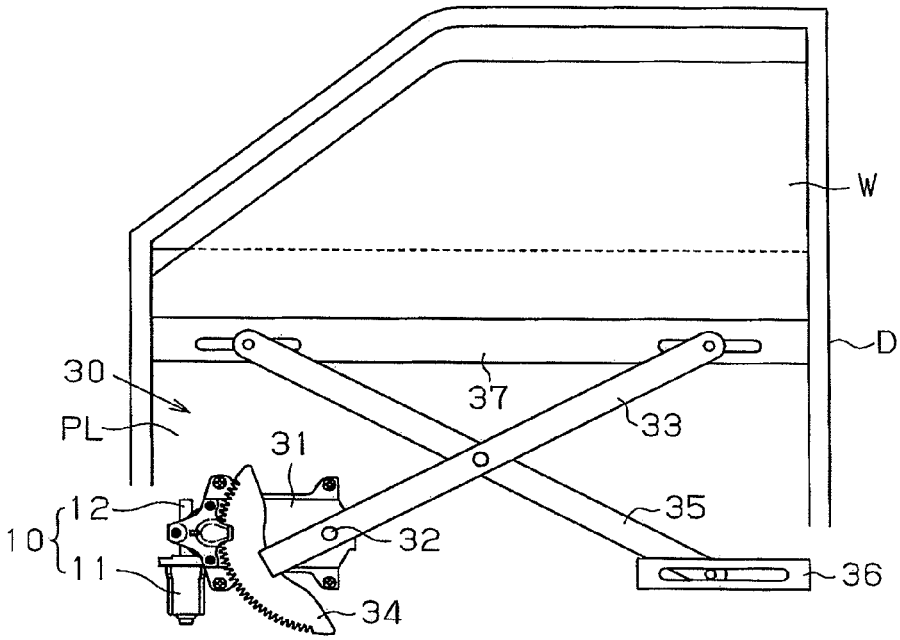
FIG. 1 is a rear view illustrating a vehicle power window apparatus according to one embodiment of the present embodiment.

As shown in FIG. 1, the vehicle power window apparatus includes a drive unit 10 and a regulator 30. The drive unit 10 includes a motor portion 11 and a speed reducing portion 12, which are integrated. The motor portion 11 is driven to rotate, and the speed reducing portion 12 reduces the speed of rotation generated by the motor portion 11 and outputs the rotation.

Figure 2:
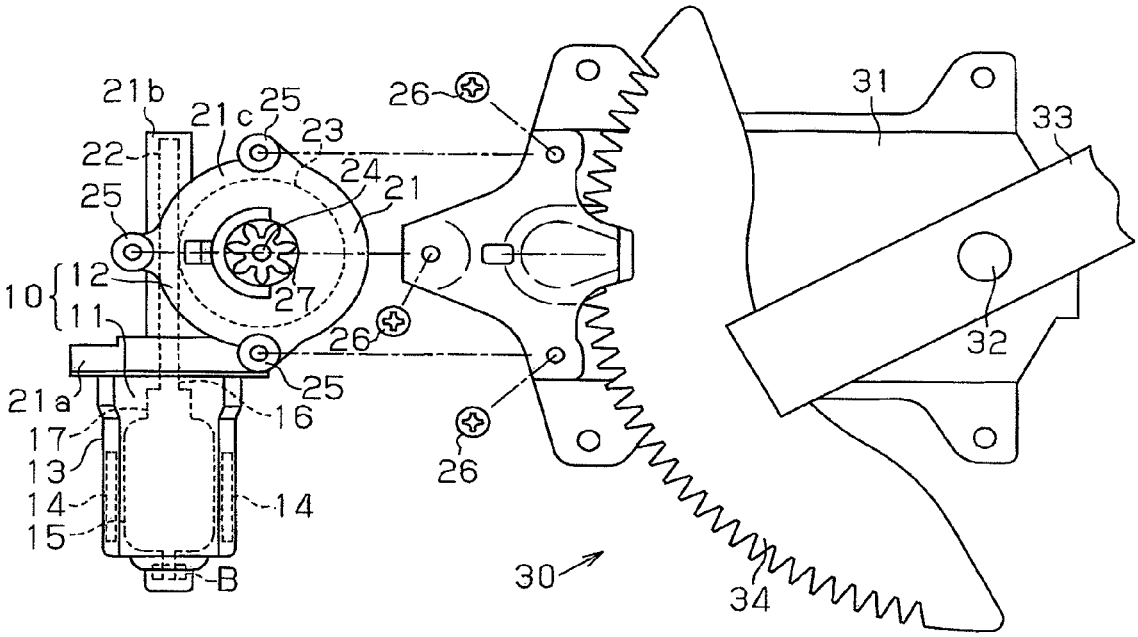
FIG. 2 is an exploded view of the power window apparatus shown in FIG. 1.

As shown in FIG. 2, the motor portion 11 includes a cup-shaped yoke housing 13 made of magnetic metal, a plurality of magnets 14 fixed to the inner surface of the yoke housing 13, a rotor 15 supported in the yoke housing 13, and a pair of brushes (not shown) held by a brush holder. The rotor 15 is rotatably supported in the yoke housing 13 with a bearing B.

The speed reducing portion 12 includes a housing 21 defining the outer shape, a worm shaft 22, a worm wheel 23, and an output shaft 24 protruding outside. The output shaft 24 is coaxially coupled to the worm wheel 23 so as to rotate integrally with the worm wheel. In the present embodiment, the worm shaft 22 and the worm wheel 23 constitute a speed reduction mechanism.

The housing 21 is made of resin and has a fixing portion 21*a* that is fixed to the yoke housing 13. The housing 21 also has a cylindrical worm accommodating portion 21*b* and a substantially cup-shaped wheel accommodating portion 21*c*. The worm accommodating portion 21*b* extends along the extension of the rotary shaft 16 of the rotor 15 and rotatably supports the worm shaft 22 therein. The wheel accommodating portion 21*c* has an inner diameter that is larger than the outer diameter of the worm wheel 23. The opening of the wheel accommodating portion 21*c* is covered, for example, by a metal cover (not shown).

The worm shaft 22 is operatively coupled to the rotary shaft 16 with a clutch (not shown). The clutch prevents the rotary shaft 16 from being rotated by force applied by a load. The interior of the worm accommodating portion 21*b* partly communicates with the interior of the wheel accommodating portion 21*c*, and the worm shaft 22 and the worm wheel 23 are meshed with each other in the communicating portion.

As shown in FIG. 1, the regulator 30 includes a metal support base 31 fastened to an inner panel PL of a door D, a lift arm 33 pivotally coupled to the support base 31 with a spindle 32, a sector gear 34 integrally coupled to the lift arm 33, an equalizer arm 35 rotatably coupled to the lift arm 33, an equalizer bracket 36 that guides the movement of the lower end of the equalizer arm 35, and a lift arm bracket 37 that guides the movement of the upper ends of the lift arm 33 and the equalizer arm 35. An open/close body, which is a window glass W, is attached to the lift arm bracket 37.

As shown in FIG. 2, a plurality of cylindrical attaching portions 25 are integrally formed with the housing 21. The housing 21 is fixed to the support base 31 by fastening screws 26 extending through the support base 31 to the attaching portions 25. That is, the drive unit 10 is fixed to the regulator 30 at the speed reducing portion 12, and the motor portion 11 (the rotor 15) is not directly attached to the regulator 30.

A drive gear 27 is fixed to the protruding end of the output shaft 24. The drive gear 27 is meshed with the sector gear 34. Therefore, when the rotary shaft 16 (the rotor 15) is rotated by the motor portion 11, driving force is transmitted to the output shaft 24 through the worm shaft 22 and the worm wheel 23, so that the output shaft 24 (the drive gear 27) is rotated. The rotation of the drive gear 27 is transmitted to the sector gear 34, which pivots the lift arm 33 about the spindle 32. Accordingly, the regulator 30 is activated to lift or lower the lift arm bracket 37. This in turn selectively opens and closes the window glass W.

Figure 3:
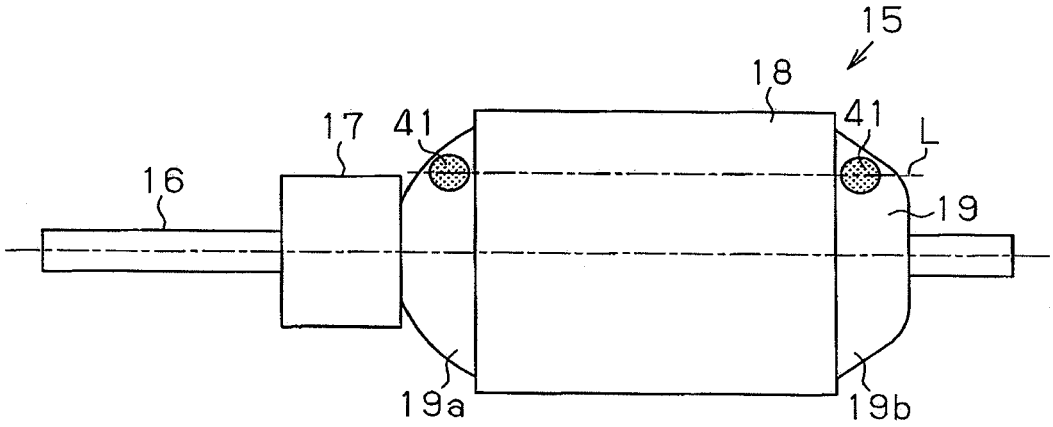
FIG. 3 is a diagram illustrating a rotor of the motor portion of the power window apparatus shown in FIG. 1.
Figure 4:
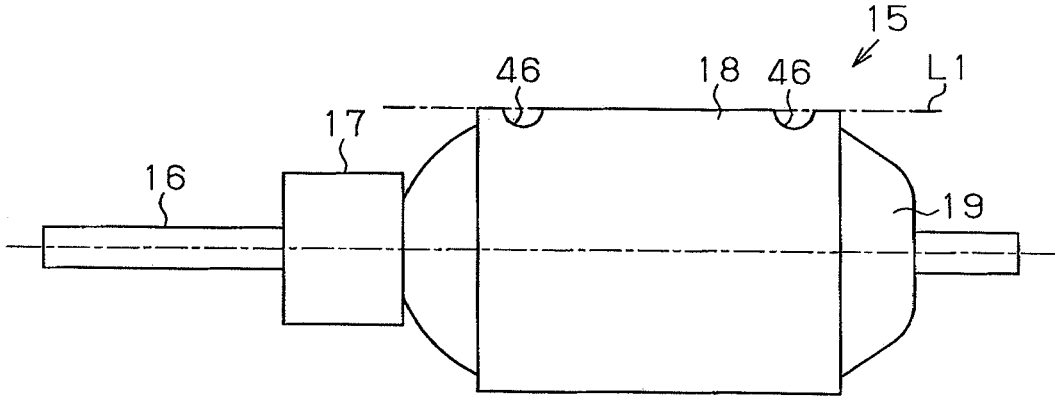
FIG. 4 is a diagram illustrating a rotor of a motor portion of a power window apparatus according to a modified embodiment.

The rotor 15 of the present embodiment will now be described. As schematically shown in FIG. 3, the rotor 15 includes a commutator 17 and an armature core 18, which are secured to and rotated integrally with the rotary shaft 16. The rotor 15 also includes a coil 19, which is wound about the armature core 18 through a plurality of slots formed in the armature core 18. The armature core 18 is located at a center in the axial direction of the rotor 15. Ends 19*a*, 19*b* of the coil 19 project from opposite axial ends of the armature core 18 (an end close to the commutator 17 and an end opposite to the commutator 17). A pair of imbalance setting portions 41 for losing the rotation balance of the rotor 15 are provided in the coil ends 19*a*, 19*b*, respectively. This configuration causes the rotor 15 (the drive unit 10) to greatly vibrate once per rotation. Each imbalance setting portion 41 is formed of, for example, putty supplied by a putty supplying device. The degree of imbalance of rotation of the rotor 15 is adjusted by the amount of the attached putty. The imbalance setting portions 41 are located on line L, which is parallel to the axis of the rotor 15, and have the same moment of inertia in relation to the axis (the rotary shaft 16).

Figure 5A:
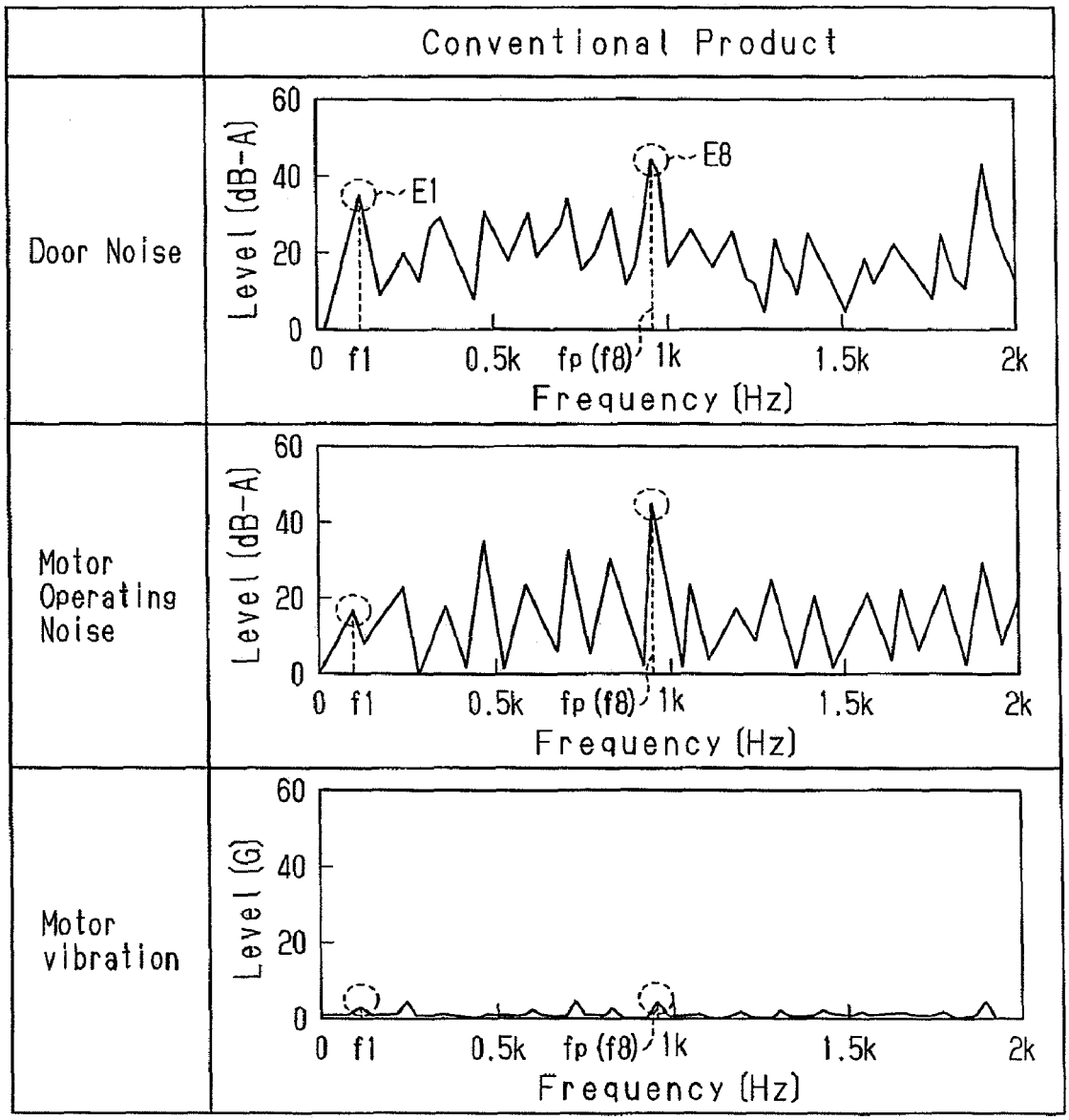
FIG. 5A is a diagram showing the frequency characteristics of door noise, motor operating noise, and motor vibration generated by a prior art power window apparatus.
Figure 5B:
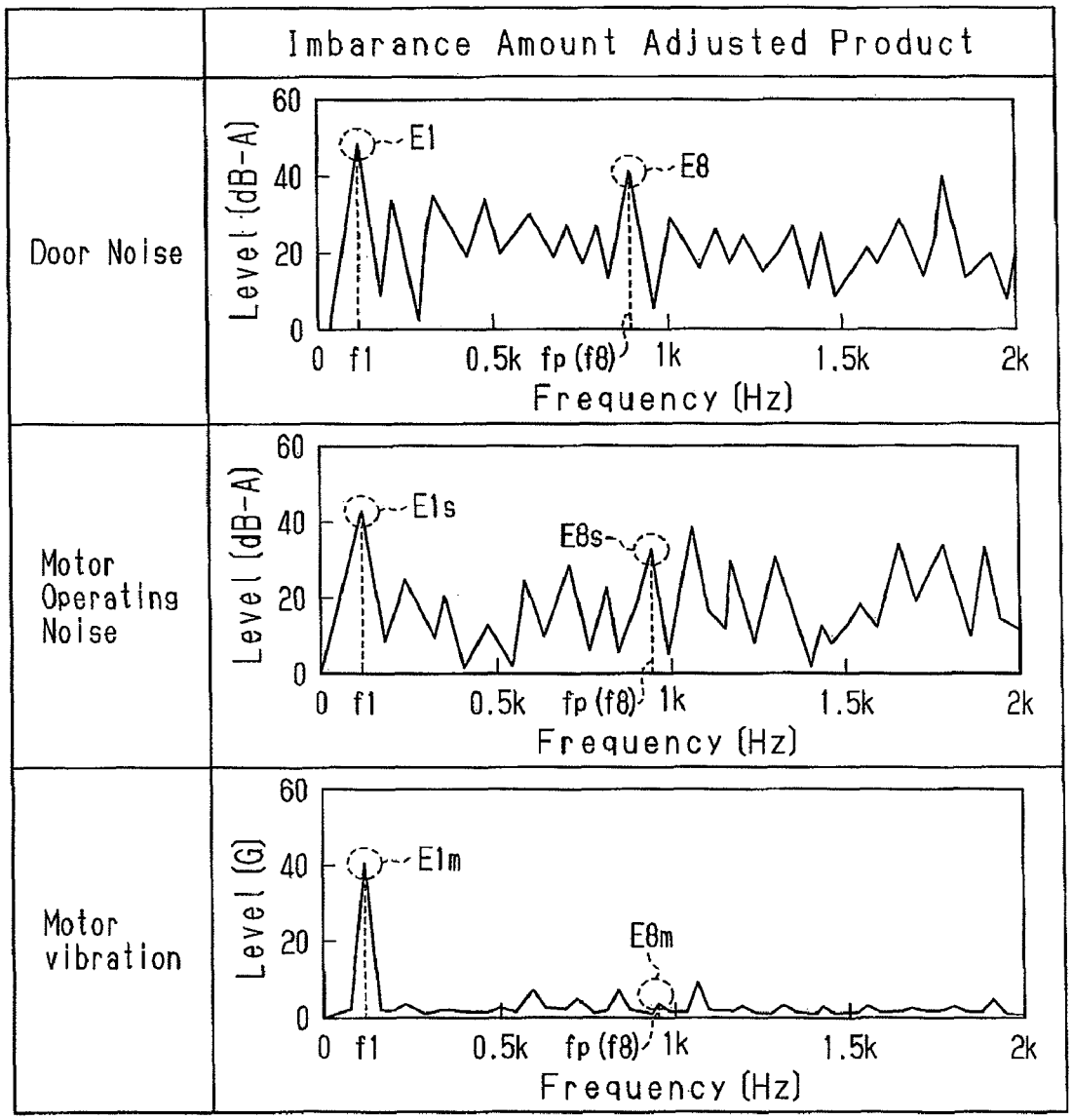
FIG. 5B is a diagram showing the frequency characteristics of door noise, motor operating noise, and motor vibration generated by a power window apparatus of the present embodiment.

In the present embodiment, the drive unit 10 (the motor portion 11) has two poles and eight slots. The drive unit 10 has a first-order frequency component f1 and an order frequency component fp of vibration (eighth-order frequency component in this case). The frequency component f1 is a frequency determined by the above expression (1), and the order frequency component fp is a frequency determined by the above expression (2). FIG. 5A shows the frequency characteristics of the door noise, the motor operating noise, and the motor vibration of a prior art vehicle power window apparatus, and FIG. 5B shows the frequency characteristics of the door noise, the motor operating noise, and the motor vibration of the vehicle power window apparatus of the present invention, in which the rotational balance of the rotor 15 is adjusted to be imbalanced. In the present embodiment, the imbalanced rotation of the rotor 15 increases the first-order frequency component E1*m* of the vibration (motor vibration) generated when the motor drive unit 10 is operating compared to that in the conventional vehicle power window apparatus. As a result, the first-order frequency component E1*s* of the motor operating noise generated when the motor drive unit 10 is operating (noise level) is increased accordingly. In the present embodiment, the first-order frequency components E1*m*, E1*s* of the motor vibration and operating noise are greater than the eighth-order frequency components E8*m*, E8*s*, which are normally the maximum values. Contrastingly, in the prior art product indicated by FIG. 5A, the first-order frequency components E1*m*, E1*s* of the motor vibration and operating noise are smaller than the eighth-order frequency components E8*m*, E8*s*. In the present embodiment indicated by FIG. 5B, the first-order frequency components E1*m*, E1*s* of the motor vibration and operating noise are the maximum values.

The magnitude correlation between the first-order frequency component E1 and the eighth-order frequency component E8 of the door noise, which includes vibration transmission noise, which is generated when vibration generated by operation of the drive unit 10 is transmitted to the inner panel PL through the regulator 30, is also inverted. In the present embodiment, the first-order frequency component E1 in the frequencies of the door noise is greater than any other nth frequency component (n is an integer greater than or equal to two). That is, the first-order frequency component E1 has the greatest value. Accordingly, the noise of a low frequency range is emphasized.

The above described embodiment has the following advantages.

(1) In the present embodiment, the first-order frequency component E1 in the door operating noise is made to have the greatest value, so that noise in the low frequency range is emphasized. Accordingly, the door noise becomes low-pitched sound. This makes unpleasant high-pitched noise harder to perceive.

(2) In the present embodiment, the first-order frequency component E1*m* of the vibration frequency of the drive unit 10 is increased simply by making the rotation of the rotor 15 of the drive unit 10 (the motor portion 11) imbalanced.

(3) In the present embodiment, the imbalance setting portions 41 for making rotation of the motor rotor 15 of the drive unit 10 imbalanced are provided at two positions that are on opposite sides of the axial center of the rotor 15 and on the same line (L) parallel to the axis of the rotor 15. This prevents rotation of the rotor 15 from being twisted. Therefore, while making rotation of the rotor 15 imbalanced, the rotor 15 is constantly brought into contact with the bearing B in a line parallel to the axis. This prevents the bearing B from being unevenly worn.

(4) In the present embodiment, the drive unit 10 is fixed to the regulator 30 at the speed reducing portion 12. This inhibits the regulator 30 from restraining the rotor 15 (the motor portion 11). Accordingly, vibration generated in the rotor 15 is reliably transmitted to the regulator 30 through the speed reducing portion 12. Therefore, sound of low frequency range in the door noise is reliably emphasized.

(5) In the present embodiment, the first-order frequency component E1*m* of the vibration frequency of the drive unit 10 is set to be in a frequency range from 20 Hz to 500 Hz. This makes the first-order frequency component E1*m* of the door noise, or low-pitched sound, pleasant to the ear.

The above described embodiment may be modified as follows.

Instead of the imbalance setting portions 41 described above, parts of the armature core 18 may be removed to form bowl shaped imbalance setting portions (negative balance adjustment). The degree of imbalance of rotation of the rotor 15 is adjusted by the amount of parts of the armature core 18 that are removed. The imbalance setting portions 46 are located on both sides in the axial direction of the armature core 18. The imbalance setting portions 46 are located on line L1, which is parallel to the axis of the rotor 15, and have the same moment of inertia in relation to the axis (the rotary shaft 16). In addition to the advantages of the previous embodiment, the present modified embodiment eliminates the necessity of addition of material such as putty.

In the above embodiments, three or more imbalance setting portions (putty or removed portions) may be provided on line L, L1.

In the above embodiments, the first-order vibration frequency of the drive unit 10 and other parameters (speed reduction ratio, drive voltage, load) are presented by way of example only. The number of poles and slots of the drive unit 10 are also presented by way of example only.

In the above embodiments, the manner in which the drive unit 10 (the speed reducing portion 12) is fixed to the regulator 30 (the support base 31) is only one example. For example, the drive unit 10 and the regulator 30 may be provided with engaging portions for determining the position of the drive unit 10. To prevent the drive gear 27 and the sector gear 34 from being disengaged from each other, the support base 31 may be provided with a cover portion that holds the drive gear 27 and the sector gear 34 with the housing 21 (the wheel accommodating portion 21*c*).

What is claimed is:

1. A method for suppressing noise in a door having an inner panel, the door incorporating a drive apparatus that opens and closes an open/close body provided in the door, wherein the drive apparatus includes a motor, and a regulator fixed to the inner panel, wherein the regulator receives drive force from the motor and selectively opens and closes the open/close body, wherein noise is generated in the door when the motor is operating, the door noise including motor operating noise and vibration transmission noise that is generated when vibration of the motor is transmitted to the inner panel via the regulator, the method comprising:

providing the motor with a rotor that has imbalance setting portions at least two positions that are on a single straight line parallel with the axis of the rotor and on both sides of the axial center of the rotor and that is configured to rotate in an imbalanced manner; and setting a first-order frequency component in vibration of the motor to be greater than any other nth component, where "n" is an integer greater than or equal to two, so that the first-order frequency component in the door noise is greater than any other nth frequency component, where "n" is an integer greater than or equal to two.

2. The method according to claim 1, further comprising:

setting the first-order frequency component in vibration of the motor to be in a frequency range from 20 Hz to 500 Hz.

* * * * *